United States Patent [19]

McClellan

[11] Patent Number: 4,562,783

[45] Date of Patent: Jan. 7, 1986

[54] NEEDLE FINGER GUARD AND COOLING DEVICE FOR A SEWING MACHINE

[76] Inventor: Dale McClellan, Rte. 7, Box 684, Easley, S.C. 29640

[21] Appl. No.: 533,410

[22] Filed: Sep. 19, 1983

[51] Int. Cl.[4] ..... D05B 83/00

[52] U.S. Cl. ..... 112/281; 112/261

[58] Field of Search ..... 112/281, 261, 240

[56] References Cited

U.S. PATENT DOCUMENTS

| | | | |
|---|---|---|---|
| 1,070,823 | 8/1913 | Lavoie et al. | 112/261 |
| 2,065,031 | 12/1936 | Sklar | 112/261 |
| 2,259,683 | 10/1941 | Damiano | 112/261 |
| 2,650,557 | 9/1953 | Hauser | 112/281 |
| 2,669,207 | 2/1954 | Happe | 112/281 |
| 3,019,751 | 2/1962 | Fichera | 112/261 |
| 3,145,674 | 8/1964 | Kurihara | 112/240 |
| 3,326,160 | 6/1967 | Murino | 112/240 |
| 3,611,958 | 10/1971 | Rutledge | 112/281 |
| 4,178,865 | 12/1979 | Odermann et al. | 112/261 |
| 4,285,293 | 8/1981 | Martling | 112/281 |

FOREIGN PATENT DOCUMENTS

| | | | |
|---|---|---|---|
| 6909881 | 12/1970 | Netherlands | 112/240 |
| 183580 | 8/1966 | U.S.S.R. | 112/281 |

*Primary Examiner*—Werner H. Schroeder
*Assistant Examiner*—Andrew M. Falik
*Attorney, Agent, or Firm*—Julian W. Dority

[57] ABSTRACT

A combination finger guard and needle protector for use on a sewing machine having a reciprocating needle and presser foot. The needle protector includes a bracket which is attached to a support arm of the sewing machine and has an air jet carried thereon. A source of pressurized air is connected to the air jet for cooling the needle during the sewing operation. A substantially U-shaped member is carried adjacent a front end of the bracket partially encircling the reciprocating needle for providing a finger guard for the needle.

2 Claims, 3 Drawing Figures

NEEDLE FINGER GUARD AND COOLING DEVICE FOR A SEWING MACHINE

BACKGROUND OF THE INVENTION

In sewing synthetic fibers and, particularly, when sewing binders on multi-ply fabric, often the reciprocating needle of the sewing machine will heat up to such a degree that the needle will damage the fabric by fusing or melting the fabric being sewn.

There is also the problem that while sewing the binder on fabric, the operator's fingers will come in contact with the needle so as to be injured thereby.

In an attempt to avoid such problems, finger guards have been mounted on sewing machines to prevent the operator from accidentally allowing her finger to come in contact with the reciprocating needle. An example of typical finger guards are disclosed in U.S. Pat. Nos. 2,065,031 and 2,259,683.

Also attempts have been made to provide apparatus for cooling the needle during the sewing operation. In U.S. Pat. No. 2,316,647, a liquid coolant is deposited on a pad through which the needle reciprocates during the sewing operation to aid in maintaining the needle cool. In U.S. Pat. No. 2,690,148, there is disclosed a sewing machine needle cooler which supplies a stream of fluid such as air to the tip of the needle for cooling the needle during the sewing operation. The needle cooling device includes a hollow body which is mounted on the needle clamp for reciprocating up and down with the needle during the sewing operation.

SUMMARY OF THE INVENTION

Accordingly, it is an important object of the present invention to provide a combined cooling device and finger guard for a reciprocating needle of a sewing machine.

Another important object of the present invention is to provide a simple device that can be readily mounted on the foot of a sewing machine for cooling the needle of the machine and for acting as a finger guard for the machine.

Still another important object of the present invention is to provide a needle cooling device and protector for a sewing machine which does not interfere with the operation of the machine.

The construction designed to carry out the invention will be hereinafter described, together with other features thereof.

The invention will be more readily understood from a reading of the following specification and by reference to the accompanying drawing forming a part thereof, wherein an example of the invention is shown and wherein:

DESCRIPTION OF A PREFERRED EMBODIMENT

Figure 1:
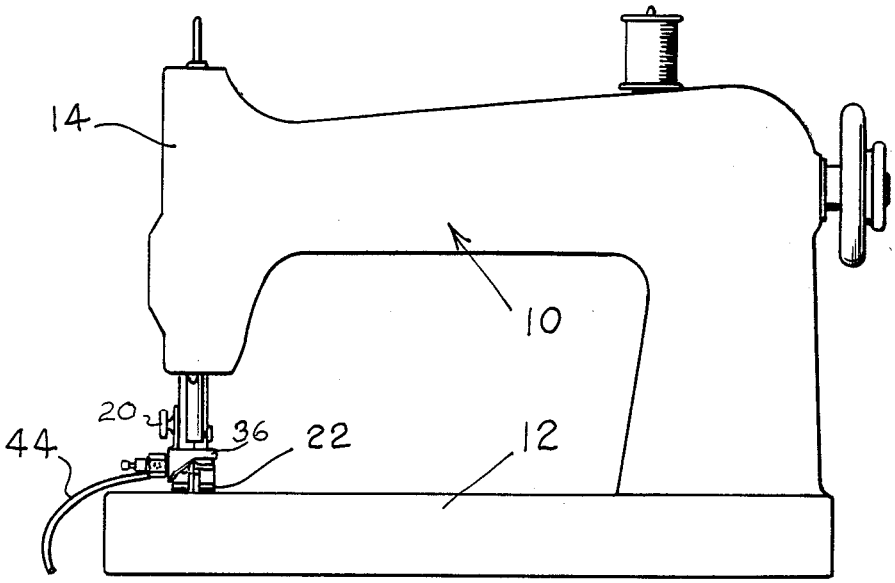
FIG. 1 is a side elevational view illustrating a sewing machine equipped with a finger guard and needle cooling device constructed in accordance with the present invention.
Figure 2:
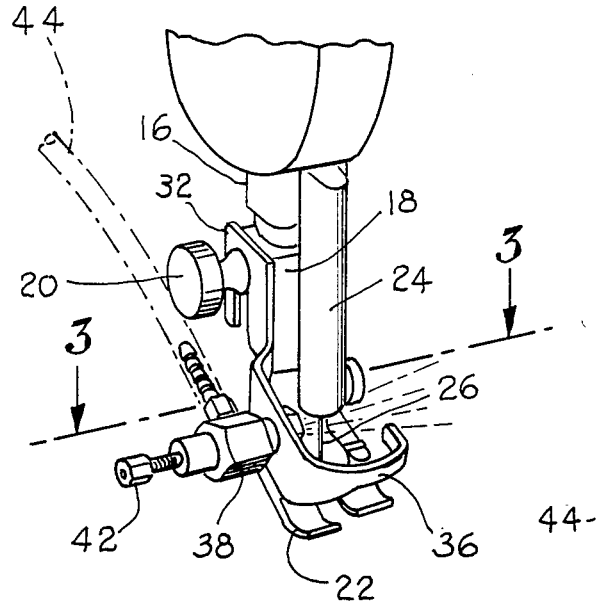
FIG. 2 is an enlarged perspective view illustrating the combined finger guard and needle cooling device.
Figure 3:
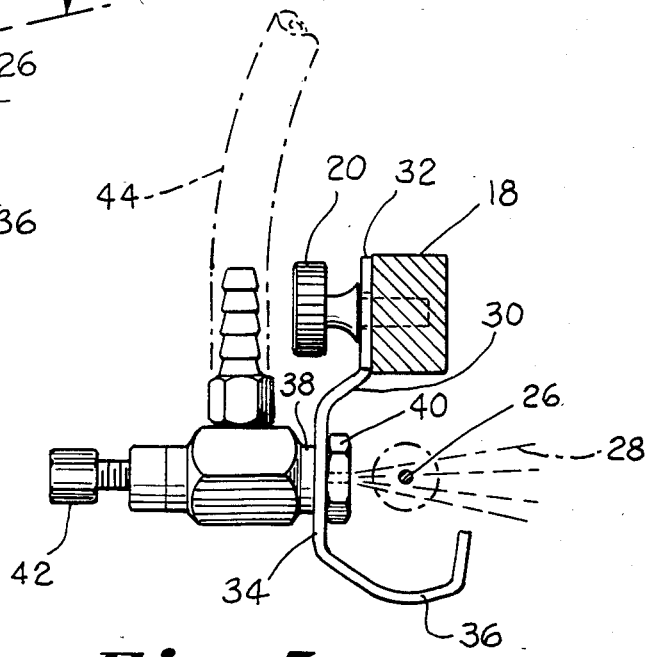
FIG. 3 is a sectional view taken along line 3—3 of FIG. 2.

In FIG. 1, there is illustrated a conventional sewing machine 10 that is used for sewing fabric. Often, when sewing bindings on fabric and especially synthetic fabric, the needle will heat up as a result of the frictional contact with the multi-plies of fabric. If the fabric being sewn is a synthetic fabric such as polyester, it will tend to melt or fuse the fabric. Also, as the needle heats up, a coating will develop thereon which interferes with the sewing operation.

As a result, it is important that the needle be cooled during the sewing operation; and also while it is being cooled, it is important that a needle guard be positioned around the reciprocating needle so as to prevent the operator from accidentally letting her finger come in contact with the needle during the sewing operation.

The sewing machine is a conventional sewing machine having a base portion 12 and a head 14. The lower end of the head 14 has projecting outwardly therefrom a presser bar 16 which has a yoke 18 at its lower end in which a slotted upper end of the presser foot extends and is adjustably mounted therein by means of a thumbscrew 20.

The presser foot includes a bifurcated foot portion 22 through which the needle reciprocates during the sewing operation. The presser foot 22 is pivotably mounted in the conventional manner.

Also extending out of the lower end of the sewing machine head is a needle bar 24 which has a needle 26 projecting out the lower end thereof.

A bracket 30 is attached to the yoke or support arm 18 by means of a slotted inner end 32 which extends over a shank portion of the thumbscrew 20. The bracket has an intermediate portion 34 and a U-shaped portion 36 adjacent its remote end. The U-shaped portion 36 extends partially around the needle 26 for preventing the operator from accidentally allowing her fingers to come in contact with the reciprocating needle.

An air jet 38 is secured to the intermediate portion 34 of the bracket by means of a nut 40. The air jet faces the needle 26 for directing a stream of pressurized air onto the needle.

The air jet 38 has an adjustable needle valve 42 which can be rotated for varying the flow of air to the needle 26. A pressurized source of air (not shown) is coupled to the air jet 38 by means of a flexible hose 44.

In operation, when it is desired to insert the combined finger guard and needle cooling device on the sewing machine, it is only necessary to rotate the conventional thumbscrew 20 and insert the inner end of the bracket 32 over the shank portion of the thumbscrew 20. As can be seen, the entire guard remains stationary as the needle bar 24 and needle 26 reciprocates back and forth during the sewing operation. By adjusting the needle valve 42, the stream of air 28 can be varied to maintain the needle cool yet not interfere with the sewing operation.

The U-shaped portion 36 as shown in the drawings has a thickness that diminishes between two points located above the tips of the inside and outside leg portion of the presser foot 22 with the clearance between the bottom edge of the bracket and surface of the inside presser foot leg tip being substantially greater than the clearance between the bottom edge and surface for the outside presser foot leg tip.

While a preferred embodiment of the invention has been described using specific terms, such description is for illustrative purposes only, and it is to be understood that changes and variations may be made without departing from the spirit or scope of the following claims.

What I claim is:

1. A combined needle cooling device and protector for use on a sewing machine, said sewing machine having a reciprocating needle and a presser foot, said presser foot including a slot through which said reciprocating needle passes during operation, a vertically extending support arm, and a foot pivotally attached to said vertically extending support arm, said combined needle protector cooling device comprising:

a bracket attached to said vertically extending support arm and extending forward along side of said needle;

said bracket having an inner end portion, an intermediate portion, and an outer portion, an air jet facing said needle carried by said intermediate portion of said bracket;

said inner end portion of said bracket having a vertically elongated slot carried thereon;

said vertically elongated slot allowing said bracket to be adjustably and demountably attached to said vertically extending support arm;

said intermediate portion being substantially constant vertical thickness spaced above said pressure foot and extending horizontally over substantially the length of said pivotally attached presser foot;

said air jet being mounted substantially perpendicular to said intermediate portion of said bracket;

means for connecting said source of pressurized air to said air jet producing a stream of air for cooling said reciprocating needle while sewing said fabric; and the outer portion comprising a substantially U-shaped member located above the tips of the inside and outside legs of the presser foot carried horizontally adjacent said intermediate portion of said bracket partially encircling said reciprocating needle providing a finger guard for said needle wherein the vertical thickness of said U-shaped portion substantially diminishes between two points located above said tips of the inside and outside leg portions of the presser foot with the clearance between the bottom edge of said bracket and the surface of the inside presser foot leg tip being substantially greater than the clearance between said bottom edge and surface for the outside presser foot leg tip.

2. The needle protector as set forth in claim 1 further comprising:

valve means connected to and carried by said air jet for regulating the flow of air through said air jet.

* * * * *